US006361142B1

(12) United States Patent
Otsuka et al.

(10) Patent No.: US 6,361,142 B1
(45) Date of Patent: Mar. 26, 2002

(54) WASTE INK RESERVOIR FOR INK JET PRINTER AND INK JET PRINTER INCORPORATING THE SAME

(75) Inventors: Nobutoshi Otsuka; Zenta Kosaka, both of Matsumoto; Mayumi Takamiya, Hotaka-machi, all of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/432,830

(22) Filed: Nov. 2, 1999

(30) Foreign Application Priority Data

Nov. 6, 1998 (JP) ..... 10-316543

(51) Int. Cl.[7] ..... B41J 2/165
(52) U.S. Cl. ..... 347/36; 347/31
(58) Field of Search ..... 347/36, 35, 31

(56) References Cited

FOREIGN PATENT DOCUMENTS

| | | | |
|---|---|---|---|
| JP | 07-125257 | | 5/1995 |
| JP | 08-112911 | | 5/1996 |
| JP | 08-112914 | | 5/1996 |
| JP | 09-076531 | | 3/1997 |
| JP | 411058780 | * | 3/1999 |

* cited by examiner

*Primary Examiner*—N. Le
*Assistant Examiner*—Shih-Wen Hsieh
(74) *Attorney, Agent, or Firm*—Hogan & Hartson, L.L.P.

(57) ABSTRACT

There are provided a waste ink reservoir and an ink jet printer incorporating the waste ink reservoir. A waste ink absorber has a top surface, for receiving waste ink from the print head at the top surface, and then absorbing the waste ink for storage therein. The waste ink absorber has a plurality of ink absorbent boards arranged in a vertically layered structure and formed with respective through holes vertically extending therethrough, such that adjacent through holes of absorbent boards at each pair of respective adjacent layers are displaced from each other, thereby allowing the adjacent through holes to partially communicate with each other. A waste ink container accommodates the waste ink absorber.

2 Claims, 9 Drawing Sheets

WASTE INK RESERVOIR FOR INK JET PRINTER AND INK JET PRINTER INCORPORATING THE SAME

BACKGROUND OF THE INVENTION

1. Field of the Invention

This invention relates to a waste ink reservoir for an ink jet printer, for storing waste ink generated by cleaning of a print head, and an ink jet printer incorporating the waste ink reservoir.

2. Prior Art

A print head for an ink jet printer is prevented from being clogged due to dried ink by sucking ink droplets from all ink nozzles of the print head (cleaning) or ejecting ink droplets from the same (flushing) prior to a printing operation. The waste ink sucked or delivered from the waste ink is received by a head cap, and introduced into a waste ink reservoir comprised of a waste ink container and a waste ink absorber filled in the container.

For instance, in a waste ink reservoir disclosed in a Japanese Laid-Open Patent Publication (Kokai) No. 9-300656, a waste ink absorber formed by a laminate of six ink absorbent boards is received in a waste ink container. Top two of the six ink absorbent boards are each formed with a cut-out portion at an end thereof, whereby ink is caused to drop (flow down) from a lower end of a waste ink tube brought to a position above the cut-out portion. That is, waste ink which is relatively low in viscosity is caused to be absorbed from an intermediate portion of one end of the waste ink absorber to all area thereof. This makes it possible to store a sufficient amount of waste ink corresponding to a service life of the ink jet printer, by using a relatively small container.

In the case of such a conventional waste ink reservoir, waste ink is always dropped to the cut-out portion of the waste ink absorber (portion facing the cut-out portion), and at the same time, from this portion, it is absorbed into all area of the waste ink absorber. The waste ink dropped to the cut-out portion once stays at the cut-out portion and then it is absorbed progressively. Therefore, the surface of the waste ink is dried, and a portion highly viscose and hence hard to be absorbed adheres to the cut-out portion. This occurs repeatedly, from which clogging of the cut-out portion can result. Clogging of the cut-out portion prevents the waste ink from being absorbed by the ink absorber, so that before the ink absorber is saturated with the waste ink, the waste ink can brim over the waste ink container.

SUMMARY OF THE INVENTION

It is a first object of the invention to provide a waste ink reservoir which permits waste ink to be absorbed by a waste ink absorber uniformly and efficiently.

It is a second object of the invention to provide an ink jet printer incorporating a waste ink reservoir which permits waste ink to be absorbed by a waste ink absorber uniformly and efficiently.

To attain the first object, according to a first aspect of the invention, there is provided a waste ink reservoir for an ink jet printer having a print head, comprising:

a waste ink absorber having a top surface, for receiving waste ink from the print head at the top surface, and then absorbing the waste ink for storage therein, the waste ink absorber having vertically laminated layers of a plurality of ink absorbent boards each formed with a through hole vertically extending therethrough, and arranged such that vertically adjacent through holes of ones of the ink absorbent boards at each pair of respective adjacent layers are displaced from each other, thereby allowing the adjacent through holes to partially communicate with each other; and a waste ink container accommodating the waste ink absorber.

According to this waste ink reservoir, waste ink flowing (dropped) down onto the top surface of the waste ink absorber (top surface of an ink absorbent board at an upper most layer) once spreads thereon, and then it is gradually absorbed by the ink absorbent board. As the waste ink spreads over the top surface of the waste ink absorber, part thereof flows down through the through hole of the ink absorbent board onto a top surface of an ink absorbent board at an immediately lower layer. If the amount of waste ink is large, the waste ink flows down onto top surfaces of ink absorbent boards at even lower layers, as if it flows down stair steps, while being gradually absorbed by each ink absorbent board. As a result, the time over which waste ink stays on the top surface of the ink absorber is reduced, and drying of part thereof is suppressed, while being brought into contact with a large area of the ink absorber and uniformly absorbed there from. This reduces the possibility of clogging of the waste ink absorber by the dried waste ink.

That is, waste ink constantly flows without stopping or remaining at a place, until it is absorbed by each ink absorbent board, and further it is brought into contact with a waste ink absorber in a wide area to be uniformly absorbed as a whole, which makes it possible to sufficiently prevent the waste ink absorber from being clogged by waste ink. This enables waste ink to be uniformly and efficiently absorbed by the waste ink absorber, and hence the ink jet printer itself can be designed compact.

Preferably, ones of the ink absorbent boards located at respective odd-numbered layers have respective through holes each formed at a horizontally identical position and having an identical shape, and ones of the ink absorbent boards located at respective even-numbered layers have respective through holes each formed at a horizontally identical position and having an identical shape.

According to this preferred embodiment, identical ink absorbent boards can be used for odd-numbered layers, and other identical ink absorbent boards can be used for even-numbered layers. This contributes to reduction of manufacturing costs.

Alternatively, each of the plurality of ink absorbent boards has the through hole formed at an identical position offset from a center thereof and having an identical shape, ones of the plurality of ink absorbent boards at respective even-numbered layers are laminated in a vertically reversed and/or horizontally reversed relationship with respect to each of ones of the plurality of ink absorbent boards at respective odd-numbered layers.

According to this preferred embodiment, identical ink absorbent boards can be used for all the layers, simply by reversing the top and bottom sides, or the left and right sides, and this contributes to reduction of manufacturing costs.

Preferably, the vertically adjacent through holes of absorbent boards at the each pair of respective adjacent layers are different in number from each other.

According to this preferred embodiment, the direction of flow of the waste ink flowing down as if on stair steps can be more easily deranged, whereby the waste ink can be fully spread onto the top surface of each ink absorbent board.

More preferably, the number of through holes of an ink absorbent board at a lower layer is larger the number of through holes of an ink absorbent board at an upper layer.

According to this preferred embodiment, the lower layer where the smaller amount of waste ink flows down is brought into contact with the waste ink at more dispersed areas thereof, which enables the waste ink absorber to uniformly absorb the waste ink at the whole area thereof.

Preferably, the waste ink absorber further includes a lowermost laminated layer of an ink absorbent board having no through hole.

According to this preferred embodiment, waste ink dropped onto a portion of the ink absorbent board at the lowermost layer through the through hole of the upper layer fully spreads on the surface of the ink absorbent board, which enables the waste ink to be efficiently absorbed thereby.

To attain the first object, according to a second aspect of the invention, there is provided a waste ink reservoir for an ink jet printer having a print head, comprising:

a waste ink absorber having a top surface, for receiving waste ink from the print head at the top surface thereof, and then absorbing the waste ink for storage therein, the waste ink absorber having:

vertically laminated layers of a plurality of ink absorbent boards each formed with a through hole vertically extending therethrough, a through-type ink absorber fitted through the through hole of each of the plurality of ink absorbent boards such that the through-type ink absorber extends through the plurality of ink absorbent boards, the through-type ink absorber being formed of a material which has a permeability sufficiently higher in a vertical direction than in a horizontal direction, and a waste ink container accommodating the waste ink absorber According to this waste ink reservoir, the top surface of the through-type ink absorber which is excellent in permeability in a vertical direction is exposed at the top. Therefore, as the waste ink dropped onto the top surface of the ink absorber (top surface of an ink absorbent) flows and spreads over the top surface, it is absorbed by the through-type ink absorber, and further, through the through-type ink absorber, absorbed by the ink absorbent boards at the respective layers. This reduces the time over which the waste ink stays on the top surface of the waste ink absorber, and at the same time, it is uniformly absorbed by the whole waste ink absorber. This prevents the waste ink absorber from being clogged by the waste ink.

To attain the second object, according to a third aspect of the invention, there is provided an ink jet printer comprising:

a print head for delivering ink therefrom; and a waste ink reservoir including:

a waste ink absorber having a top surface, for receiving waste ink from the print head at the top surface, and then absorbing the waste ink for storage therein, the waste ink absorber having vertically laminated layers of a plurality of ink absorbent boards each formed with a through hole vertically extending therethrough, and arranged such that vertically adjacent through holes of ones of the ink absorbent boards at each pair of respective adjacent layers are displaced from each other, thereby allowing the adjacent through holes to partially communicate with each other; and a waste ink container accommodating the waste ink absorber.

To attain the second object, according to a fourth aspect of the invention, there is provided an ink jet printer comprising:

a print head for delivering ink therefrom; and a waste ink absorber having a top surface, for receiving waste ink from the print head at the top surface thereof, and then absorbing the waste ink for storage therein, the waste ink absorber having:

vertically laminated layers of a plurality of ink absorbent boards each formed with a through hole vertically extending therethrough, a through-type ink absorber fitted through the through hole of each of the plurality of ink absorbent boards such that the through-type ink absorber extends through the plurality of ink absorbent boards, the through-type ink absorber being formed of a material which has a permeability sufficiently higher in a vertical direction than in a horizontal direction, and a waste ink container accommodating the waste ink absorber.

According to these ink jet printers, the waste ink absorber within the waste ink reservoir is not likely to be clogged, and the capacity of the waste ink container of the waste ink reservoir can be used without waste. This permits the waste ink container (waste ink reservoir) to be designed compact, and hence permits the ink jet printer itself to be designed compact, while preventing leakage of waste ink into the apparatus.

The above and other objects, features, and advantages of the invention will become apparent from the following detailed description taken in conjunction with the accompanying drawings.

DETAILED DESCRIPTION

Figure 1:
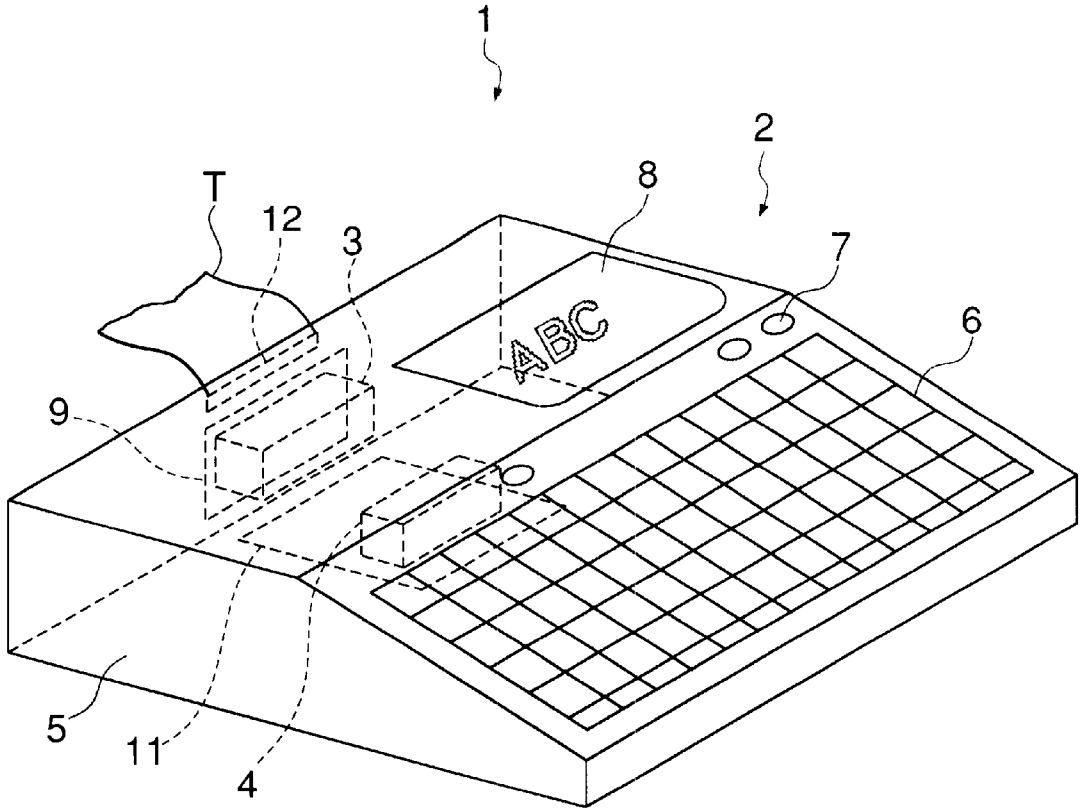
FIG. 1 is a perspective view showing an appearance of a tape printing apparatus to which are applied a waste ink reservoir and an ink jet printer according to the invention.

The invention will now be described in detail with reference to the drawings showing embodiments thereof. In the embodiments, a waste ink reservoir and an ink jet printer according to the invention are applied to a tape printing apparatus which is capable of carrying out color printing of desired characters entered by keys on a printing tape by an ink jet printing method and cutting off the printed portion or strip of the printing tape to thereby produce a label. FIG. 1 is a perspective view of an appearance of the tape printing apparatus 1. As shown in the figure, the tape printing apparatus 1 includes a tape cartridge 3 for accommodating a tape T, an ink cartridge 4 filled with different colors of ink, and a printer body 2 for removably mounting the tape cartridge 3 and the ink cartridge 4 therein.

The printer body 2 includes a body casing 5, a keyboard 6 and a button group 6 arranged in a front part of the body casing 5, and a liquid crystal display 8 in a right-side rear portion of the same. The button group 6 is comprised of a power button, a print button and so forth. A first lid 9 for mounting the tape cartridge 3 in the printer body 2 is attached to the rear side of the body casing 5, and above the first lid 9 is formed a tape exit 10 via which the tape T is delivered out of the apparatus. Further, to a bottom surface of the body casing 5 is attached a second lid 11 for mounting the ink cartridge 4 within the body casing 5.

Figure 2:
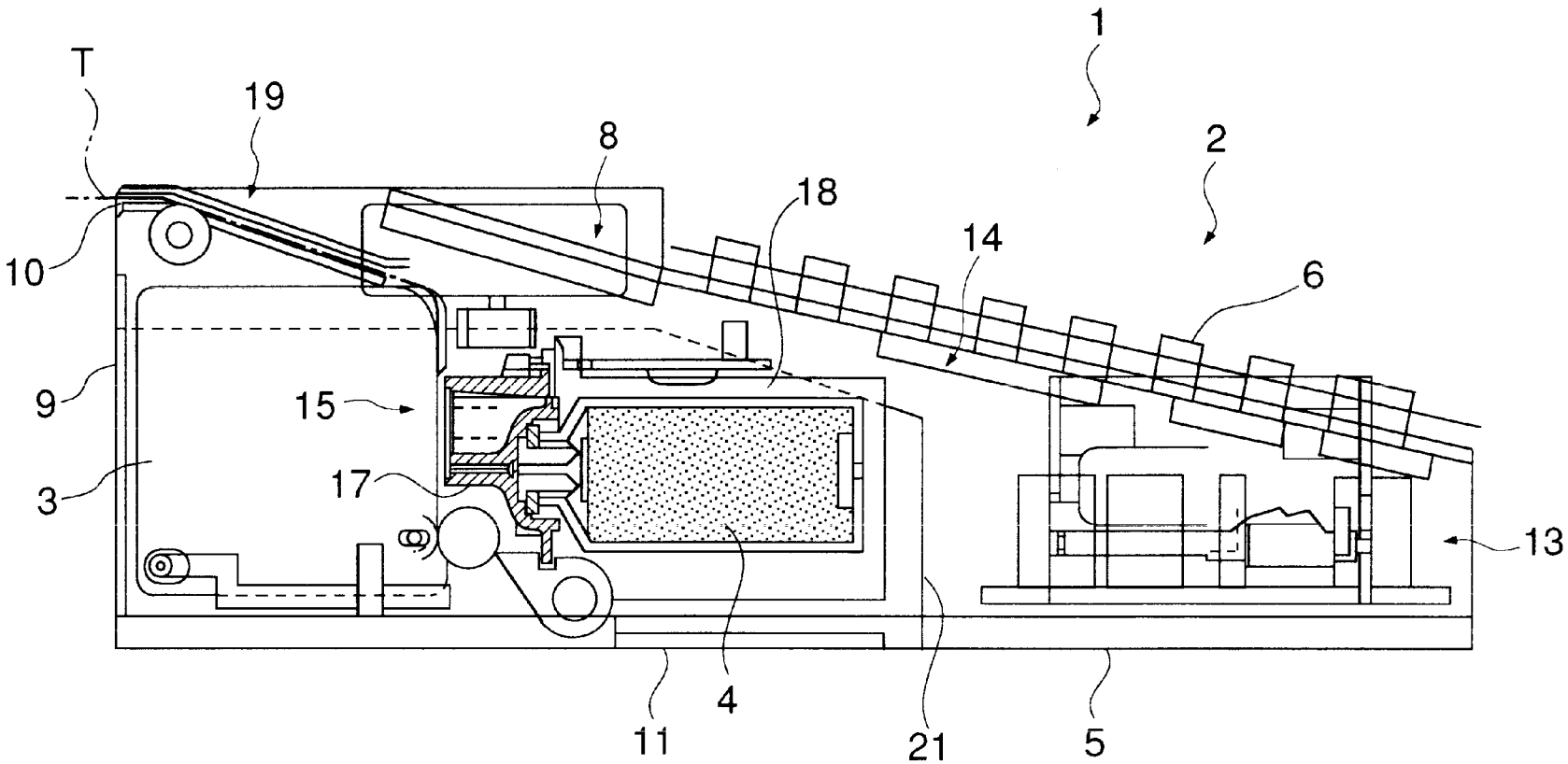
FIG. 2 is a cross-sectional view of the tape printing apparatus.
Figure 3:
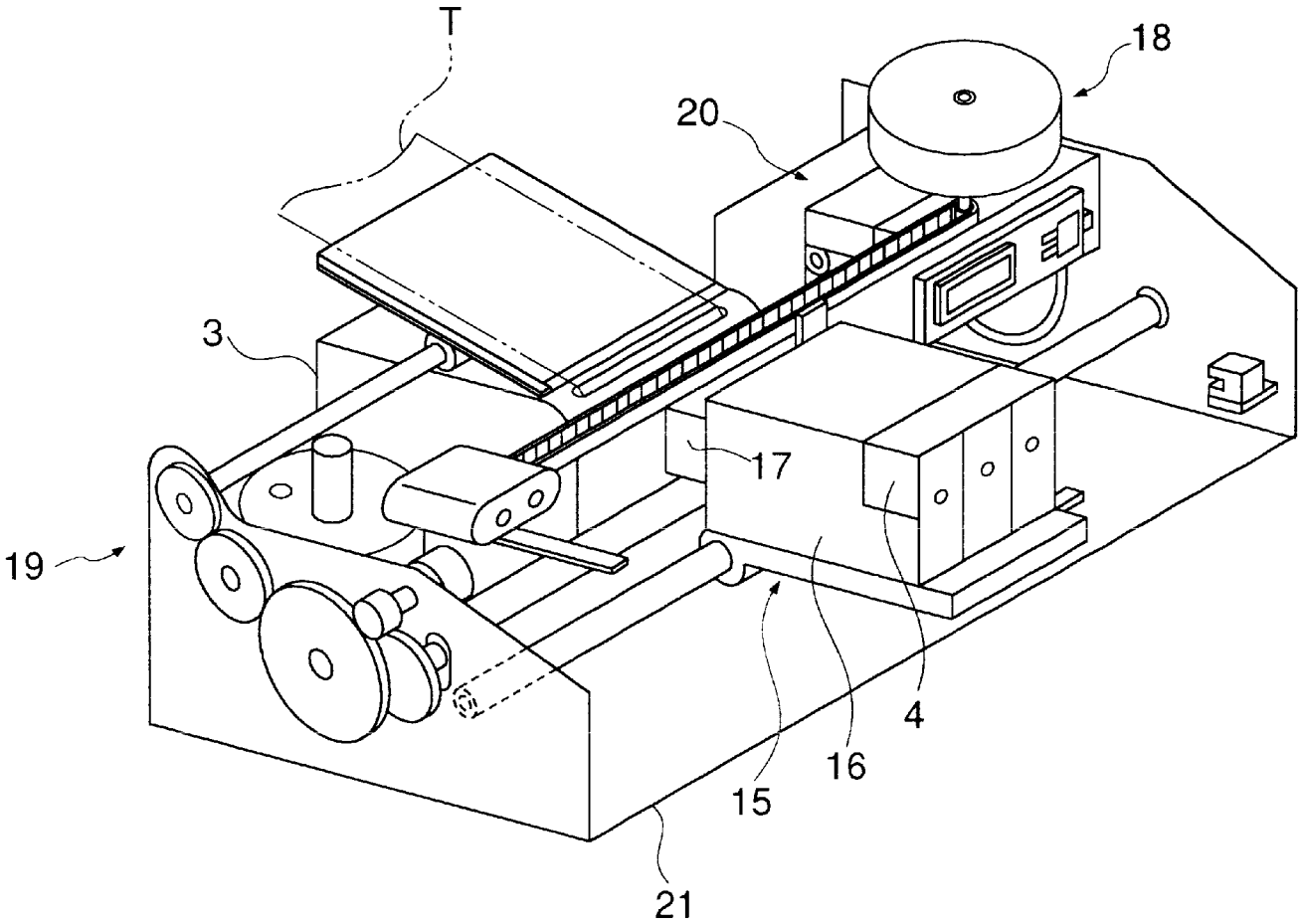
FIG. 3 is a perspective view showing an internal construction of the tape printing apparatus.

Referring to FIGS. 2 and 3, the inside of the printer body 2 includes a power supply block 13 and an information processing block 14 which are arranged in a front part thereof, a print head unit 15 comprised of a cartridge holder 16 and a print head 17 and a head-scanning block 18 for moving the print head unit 15 rightward and leftward (in the direction of the width of the tape T) which are arranged in an intermediate portion thereof, and a tape-feeding block 19 and a waste ink disposal block 20 for disposing of waste ink at the print head 17 which are arranged in a rear portion thereof. The print head unit 15, the head-scanning block 18, the tape-feeding block 19 and the waste ink disposal block 20 are supported on a base frame 21 such that they are incorporated in the body 2 in a unitized state.

The tape-feeding block 19 causes the tape T to be sent forward from the tape cartridge 3, turned upward, then, pass the printing position of the print head 17, and further turn backward to be sent out of the tape exit 10. In accordance with the feed of the tape T, the print head 17, while being supplied with ink from the ink cartridge 4, is repeatedly reciprocated rightward and leftward by the head-scanning block 18 to print on the tape T by ejecting ink droplets as required. That is, printing on the tape T is carried out by defining the direction of movement of the print head 17 as a main scanning direction and the direction of feeding of the tape T as a sub scanning direction. It should be noted that a cutter, not shown, is arranged at an intermediate portion of the feed path of the tape T to cut a printed portion of the tape T as required for sending the same out of the apparatus.

On the other hand, when the printing operation is stopped or becomes idle, an ink droplet on the end face (ink nozzles) of the print head 17 can be dried to solidify, so that the cleaning of the print head 17 is carried out, when the printing operation is stopped, whereas during a temporary halt period (longer than several seconds), the flushing of the print head 17 is carried out. To this end, when the printing operation is stopped or comes to a temporary halt, the head-scanning block 18 drives the print head 17 to bring the same to the waste ink disposal block 20.

Figure 4:
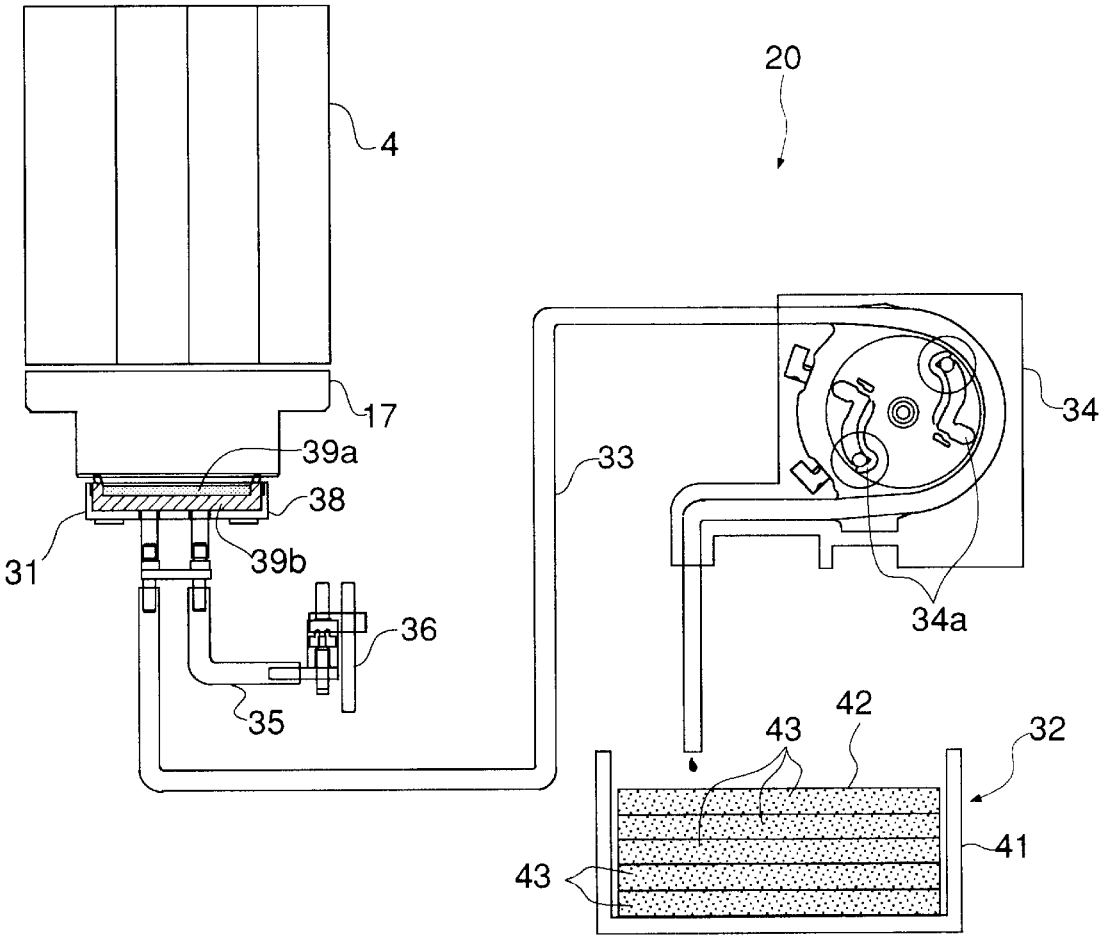
FIG. 4 is a diagram schematically showing the construction of a waste ink disposal block of the tape printing apparatus.

As shown in a FIG. 4 schematic diagram, the waste ink disposal block 20 includes a head cap 31 arranged in a manner opposed to the print head 17 so as to receive waste ink, a cap-moving mechanism (not shown) for moving the head cap 31 forward and backward, a waste ink storage block (waste ink reservoir) 32 for storing collected waste ink, a waste ink tube 33 having one end thereof connected to the head cap 31 and the other end thereof extending to the waste ink storage block 32, and a waste ink pump 34 interposed between the head cap 31 and the waste ink storage block 32. Further, an air inlet tube 35 having a distal end open to the atmosphere is connected to the head cap 31 in a manner such that a valve unit 36 is interposed at an intermediate portion of the air inlet tube 35.

When the above cleaning of the print head 17 is carried out, the head cap 31 is brought into intimate contact with the print head 17 by the cap-moving mechanism, and the waste ink pump 34 is driven for sucking ink. After the ink is sucked, the head cap 31 and the print head 17 are held in intimate contact with each to thereby prevent the ink nozzles of the print head 17 from suffering solidification (drying) of ink or adhesion of dust. Further, when the flushing of the print head 17 is carried out, the head cap 31 is held in a state separated from the print head 17 to discharge ink (eject ink droplets) from the print head 17 to the head cap 31. The head cap 31 is comprised of an ink-absorbing substance 39*a* and a cap rubber 39*b* accommodated in a cap casing 38 opening toward the print head 17. The cap rubber 39*b* is large enough to enclose the ink nozzles of the print head 17 and has its periphery pressed against the print head 17 to thereby seal a gap between the print head 17 and the cap casing 38.

The waste ink pump 34 squeezes the waste ink tube 33 by rotation of pulleys 34*a*, to thereby suck waste ink remaining in the head cap 31. There are two types of suction operation: one is a regular suction carried out when the cleaning is performed, and the other is an air suction for simply sucking waste ink staying in the head cap 31. During the regular suction, in order to suck ink from the print head 17, the valve unit 36 is actuated to close the air inlet tube 35. On the other hand, during the air suction, the valve unit 36 is actuated to open the air inlet tube 35.

The waste ink storage block 32 is comprised of a waste ink container 41 and a waste ink absorber 42 received in the waste ink container 41. The waste ink container 41 is a rectangular resin container with an open upper end, and has an enough capacity for storing waste ink in an amount corresponding to the service life of the tape printing apparatus. The waste ink absorber 42 is formed of a laminate of a plurality of rectangular fibrous ink absorbent boards 43. In this embodiment, the apparatus is configured such that waste ink flowing (dropping) down from the waste ink tube 33 is received on a top surface thereof. It should be noted that the waste ink absorber 42 is held in the waste ink container 41 such that ribs or the like, not shown, formed on the waste ink container 41 prevent the same from being made unstable or shaky.

Figure 5:
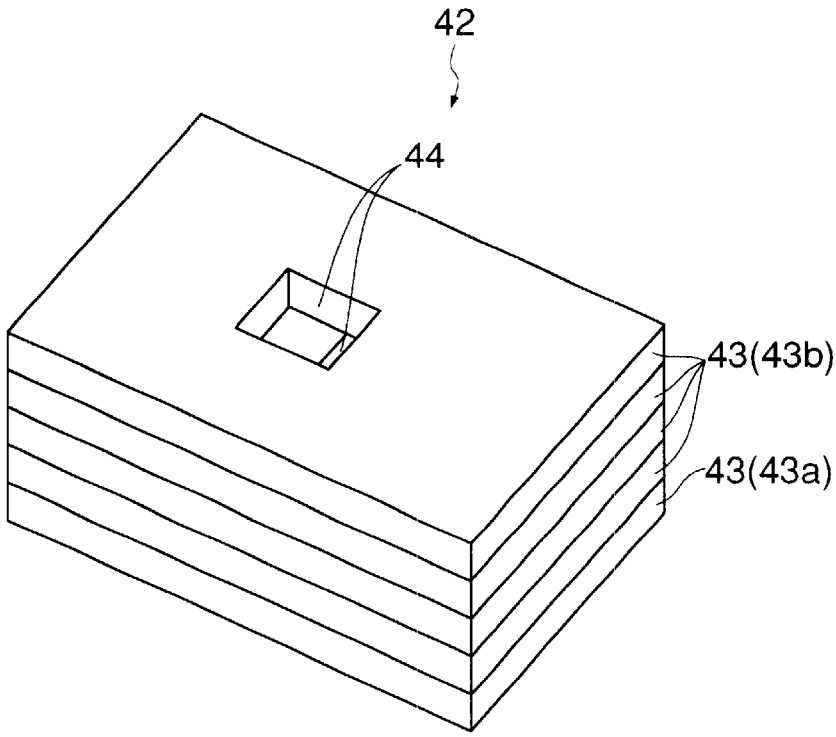
FIG. 5 is a perspective view showing an appearance of a first embodiment of the waste ink absorber.
Figure 6:
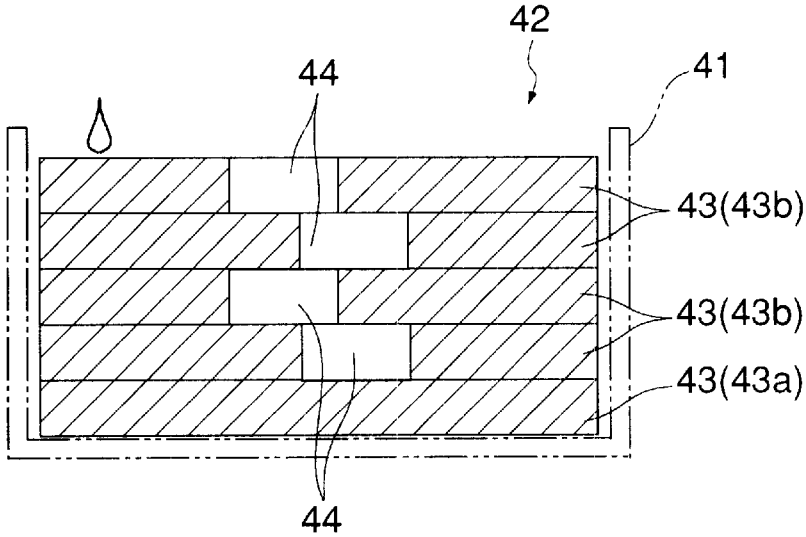
FIG. 6 is a cross-sectional view of the first embodiment of the waste ink absorber.
Figure 7:
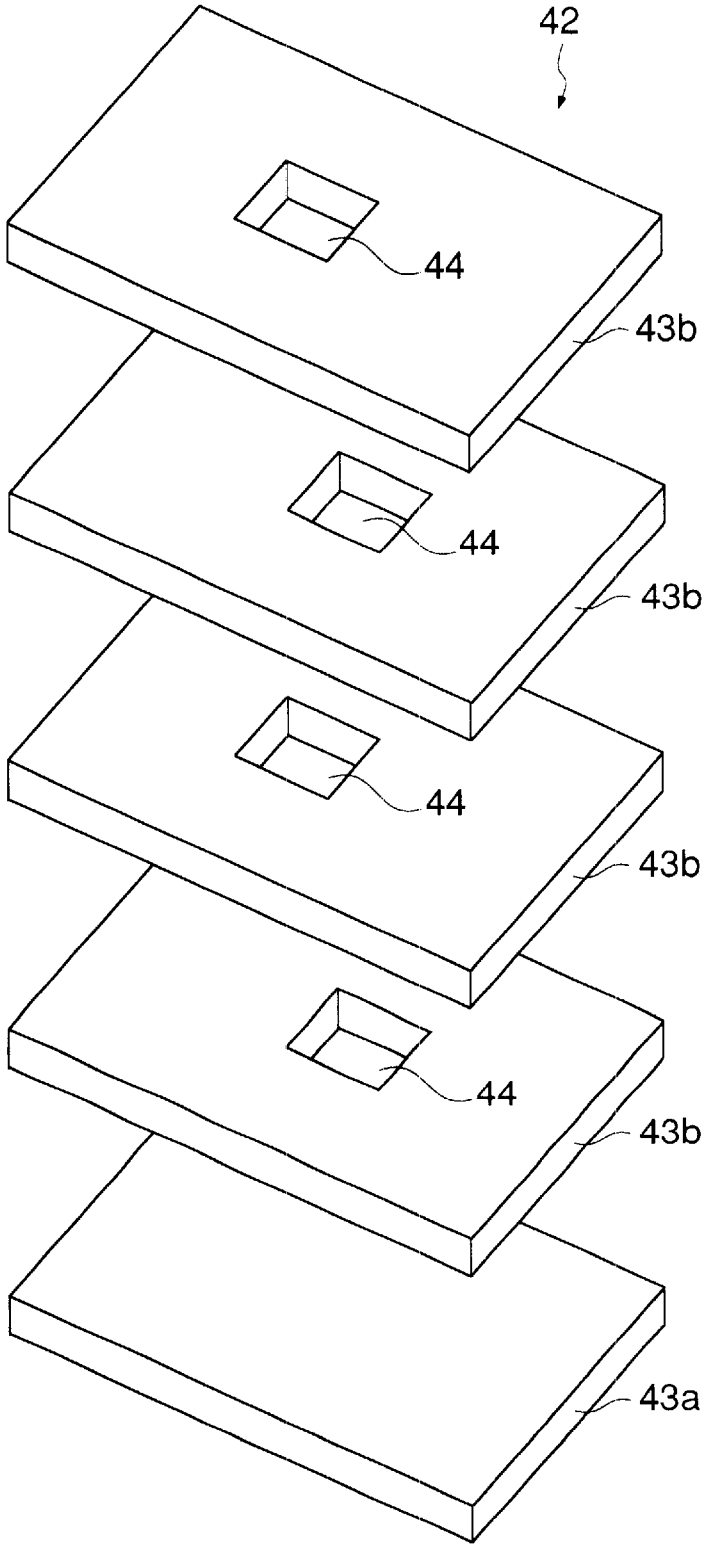
FIG. 7 is an exploded perspective view of the first embodiment of the waste ink absorber.

Next, referring to FIGS. 5 to 12, the waste ink absorber 42 will be described in detail by taking a plurality of embodiments as examples. FIGS. 5, 6 and 7 are diagrams representing the first embodiment of the waste ink absorber 42. In this embodiment, the waste ink absorber 42 is formed of vertically-laminated five ink absorbent boards 43. Ink absorbent boards 43*b* except for an ink absorbent board 43*a* placed at the bottom or a lower most layer are each formed with a rectangular through hole 44 vertically extending therethrough. That is, each of the ink absorbent boards 43*b* from a first or top layer to a fourth layer of the boards has a through hole 44 formed at a position offset from the center thereof. The through holes 44 of two vertically adjacent ink absorbent boards 43*b* are arranged in a manner displaced from each other such that parts thereof are communicated with each other. Further, the ink absorbent board 43*a* at a fifth (bottom) layer is not formed with a through hole 44.

In this embodiment, in each ink absorbent board 43*b* from the first to the fourth layer, there is formed beforehand a through hole 44 having an identical shape at an identical position offset from the center thereof along a longer side of the board. Then, every other layer of the ink absorbent boards 43*b* is rotated through 180 degrees and laminated, whereby the boards are arranged such that through holes 44 of vertically adjacent boards partially communicate with each other. Of course, each through hole 44 having an identical shape maybe formed at an identical position offset from the center of the board along a shorter side thereof. In such a case, the ink absorbent boards 43*b* are laminated in a manner such that every other layer thereof is turned upside down. Further, the ink absorbent boards 43*b* may be classified into an odd-numbered layer group and an even-numbered layer group and then through holes 44 having an identical shape at an identical position may be formed on a group-by-group basis. Furthermore, the through holes 44 may have arbitrary shapes, that is, they may have circular or triangular shapes. The number of them is also arbitrary.

According to this arrangement, waste ink dropped down on the top of the first ink absorbent board 43*b* flows and spreads on the top of the same, while being gradually absorbed by the board, and part thereof flows down through the through hole 44 onto the top of the second ink absorbent board 43*b*. Waste ink dropped down on the top of the second ink absorbent board 43*b* flows and spreads on the top of the same, while part thereof flows down through the through hole 44 of the second ink absorbent board 43*b* onto the top of the third ink absorbent board 43*b*. Thus, waste ink flows down onto lower ink absorbent boards 43*b*, as if it flows down stairsteps, while being gradually absorbed by each ink absorbent board 43*b*.

As a result, waste ink dropped onto the top of the waste ink absorber 42 is brought into contact with the absorber in a wide area in horizontal and vertical directions and uniformly absorbed by the same. Further, waste ink flows without stopping or remaining at a place, until it is absorbed, which makes it possible to suppress drying of the waste ink as well as absorb the same in a short time period, thereby preventing the waste ink absorber 42 from being clogged by waste ink. Therefore, the waste ink absorber 42 can absorb waste ink to the maximum extent thereof, until it reaches to a saturated state, and at the same time it is possible to store waste ink in the waste ink container 41 until it is filled to the capacity thereof. It should be noted that after the waste ink absorber 42 has reached to the saturated state thereof, each through hole 44 serves as a waste ink reservoir.

Figure 8:
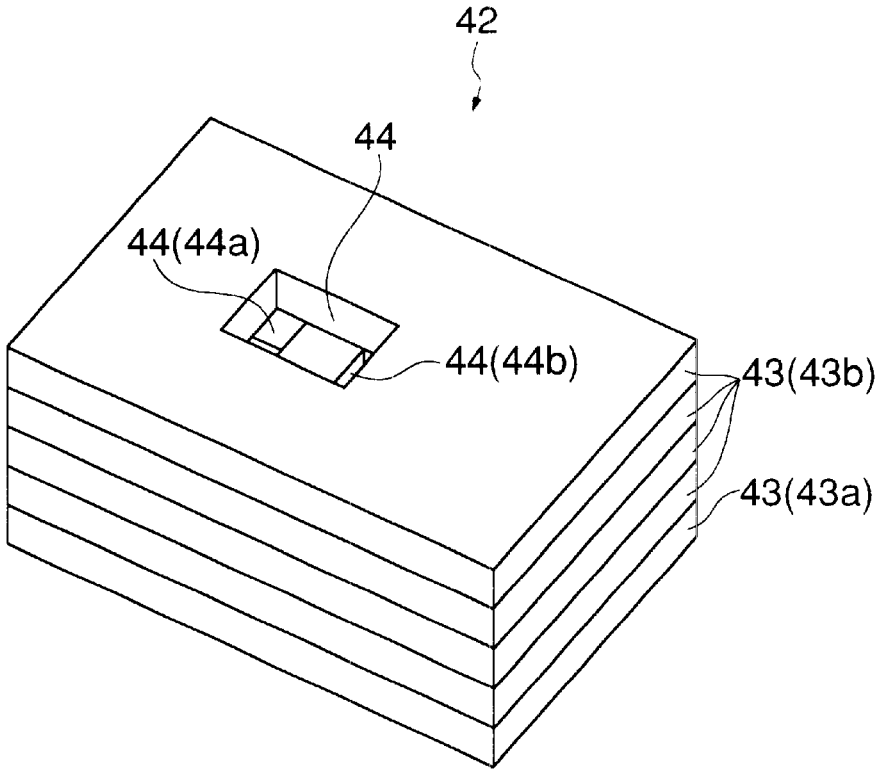
FIG. 8 is a perspective view showing an appearance of a second embodiment of the waste ink absorber.
Figure 9:
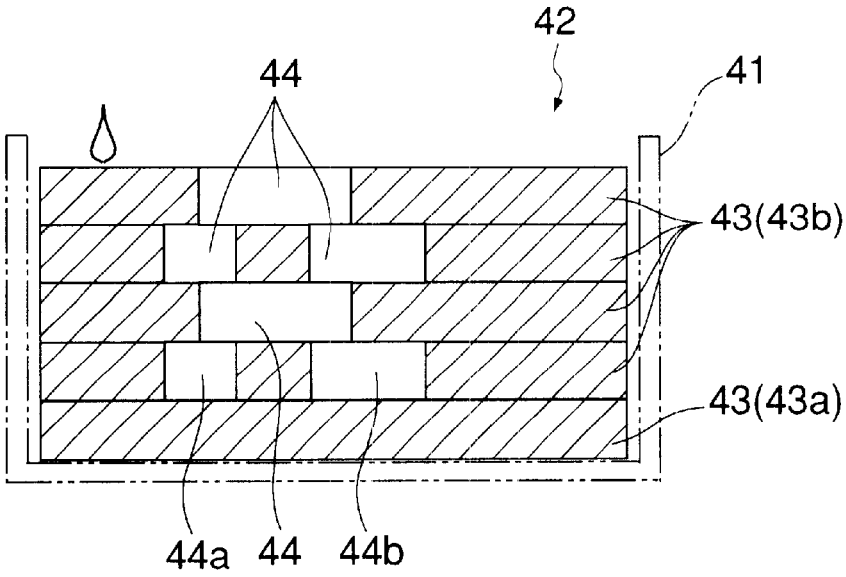
FIG. 9 is a cross-sectional view of the second embodiment of the waste ink absorber.
Figure 10:
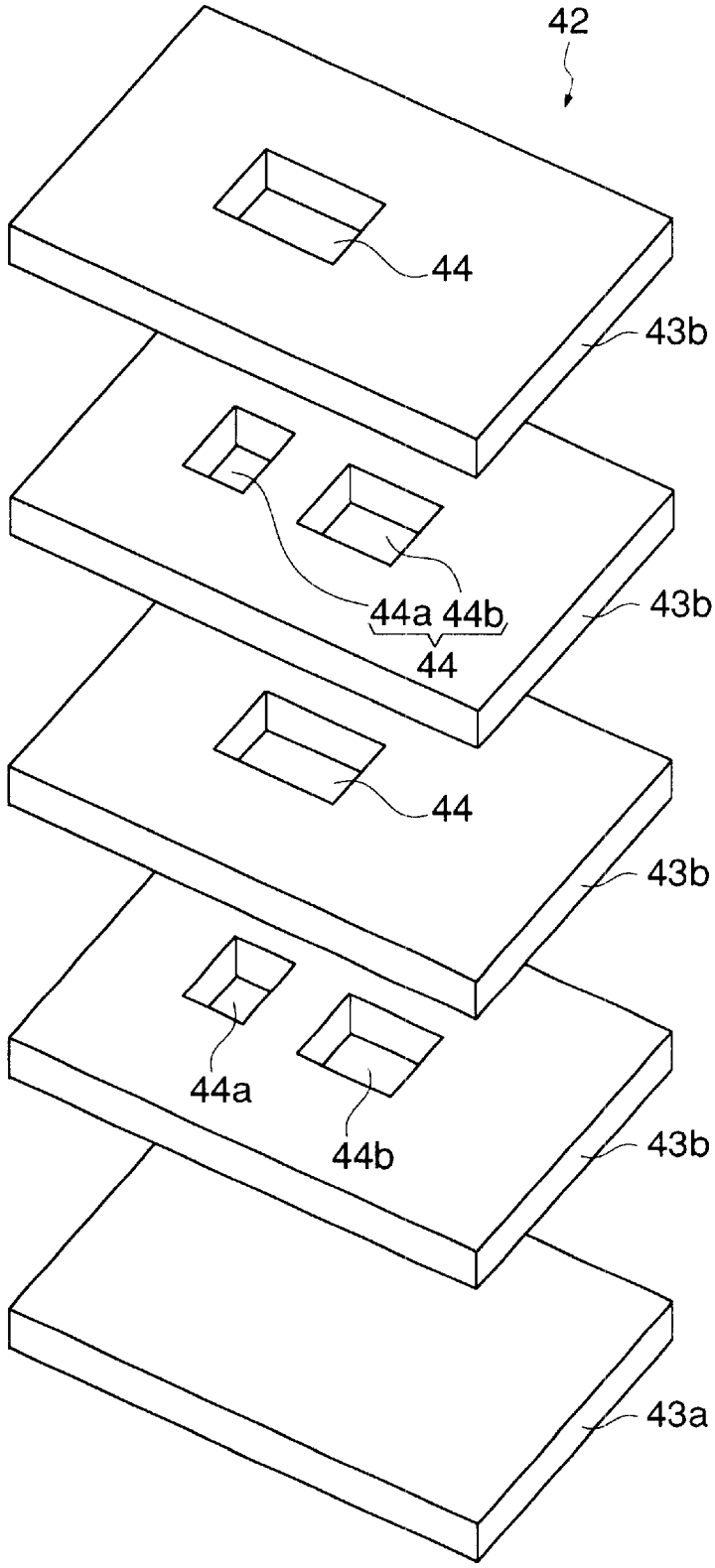
FIG. 10 is an exploded perspective view of the second embodiment of the waste ink absorber.

FIGS. 8, 9 and 10 represent a second embodiment of the waste ink absorber 42. Similarly to the above embodiment, in this embodiment as well, the waste ink absorber 42 is formed of vertically-laminated five ink absorbent boards 43. Ink absorbent boards 43*b* except for an ink absorbent board 43*a* placed at a bottom of the five boards are each formed with a rectangular through hole 44 vertically extending therethrough. However, each ink absorbent board 43*b* belonging to an odd-numbered layer group (first and third layers from the top) is formed with one through hole 44, while each ink absorbent board 43*b* belonging to an even-numbered layer group (second and fourth layers from the top) is formed with two through holes 44 (44*a*, 44*b*). In the even-numbered layer group, the through hole 44*a* closer to a dropping point of waste ink is formed to-be smaller than the remoter through hole 44*b* so as to cause waste ink to flow easily from the dropping point to a more distant place. Further, the through holes 44 vertically adjacent to each other are arranged such that they partially communicate with each other.

According to this arrangement, waste ink which flows downward as if it flows down stairsteps can be brought into contact with the waste ink absorber 42 in a broader area in the horizontal and vertical directions, thereby enabling the ink to be uniformly absorbed by the absorber. Further, waste ink flows down in split flows,or runs together, as if it flows down stairsteps. This makes it possible to suppress drying of the waste ink, to absorb the same in a short time period, thereby preventing the waste ink absorber 42 from being clogged by waste ink.

Figure 11:
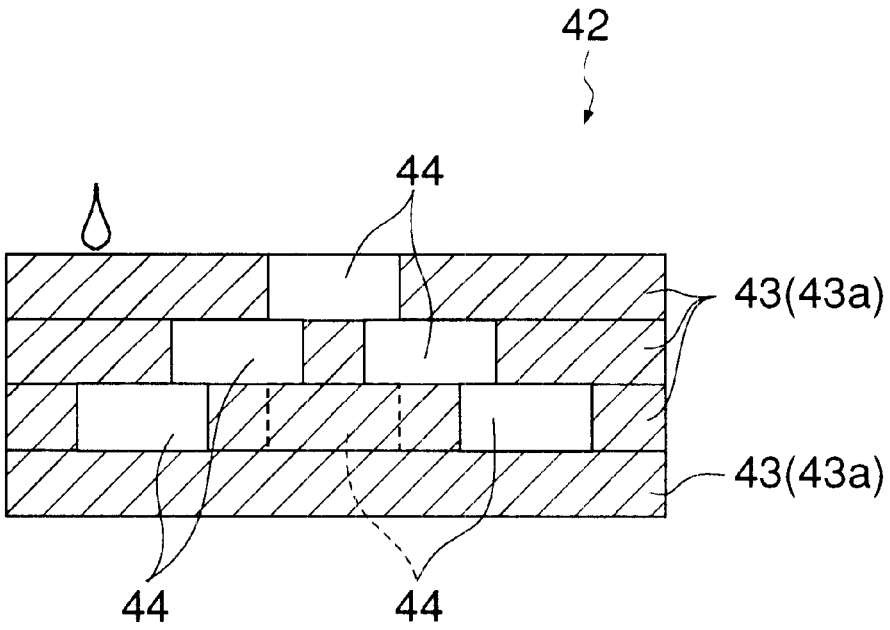
FIG. 11 is a cross-sectional view of a third embodiment of the waste ink absorber.

FIG. 11 represents a third embodiment of the waste ink absorber 42. In this embodiment, an ink absorbent board 43 located at a lower layer has more through holes 44 formed therethrough and arranged in a more spreading manner. Further, the through holes 44 vertically adjacent to each other are arranged such that they partially communicate with each other.

According to this arrangement, waste ink which flows downward as if it flows down stairsteps flows in a more dispersed manner, as it goes down the ink absorbent boards 43. This permits lower ink absorbent boards 43 to uniformly absorb waste ink, thereby preventing the waste ink absorber 42 from being clogged by waste ink.

Figure 12:
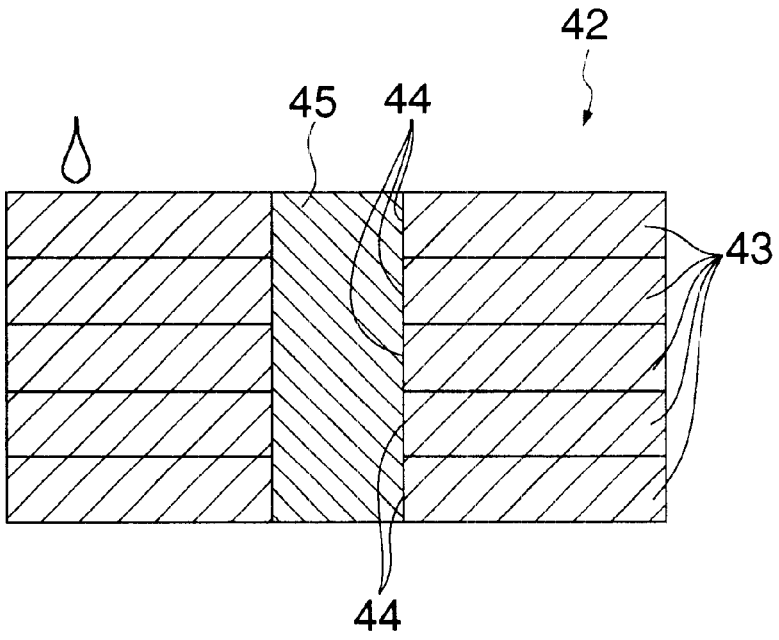
FIG. 12 is a cross-sectional view of a fourth embodiment of the waste ink absorber.

FIG. 12 represents a fourth embodiment of the waste ink absorber 42. In this embodiment, ink absorbent boards 43 each have a through hole 44 formed through an approximately central portion thereof at a horizontally identical position, and at the same time a through-type ink absorber 45 is fitted in the through holes 44 in a vertically extending manner. The through-type ink absorber 45 is formed by material having a high permeability in a direction that it extends through the waste ink absorber 42. That is, the through-type ink absorber 45 has a far higher permeability in a vertical direction than in a horizontal direction when it is arranged in the waste ink absorber 42 of the ink jet printer. Waste ink permeating from the upper end of the through-type ink absorber 45 is instantly permeates to a lower end of the through-type ink absorber 45, and then, it permeates into the ink absorbent boards 43 in contact with the through-type ink absorber 45.

According to this arrangement, waste ink dropped onto the top of the waste ink absorber 42 is absorbed as if it is sucked by the through-type ink absorber 45, and there after absorbed by the ink absorbent board 43 of each layer. Therefore, a time period over which the waste ink drifts on the top of the waste ink absorber 42 is shortened, at the same time the waste ink is relatively uniformly absorbed in the overall waste ink absorber 42, which makes it possible to more effectively prevent the waste ink absorber 42 from being clogged by waste ink.

It should be noted that the lowest ink absorbent boards of the first to third embodiments may be formed with through holes.

It is further understood by those skilled in the art that the foregoing are preferred embodiments of the invention, and that various changes and modification may be made without departing from the spirit and scope thereof.

What is claimed is:

1. A waste ink reservoir for an ink jet printer having a print head, comprising:

a waste ink absorber having a top surface, for receiving waste ink from said print head at said top surface thereof, and then absorbing said waste ink for storage therein, said waste ink absorber having:

vertically laminated layers of a plurality of ink absorbent boards each formed with a through hole vertically extending therethrough, a through-type ink absorber fitted through said through hole of each of said plurality of ink absorbent boards such that said through-type ink absorber extends through said plurality of ink absorbent boards, said through-type ink absorber being formed of a material which has a permeability sufficiently higher in a vertical direction than in a horizontal direction, and a waste ink container accommodating said waste ink absorber.

2. An ink jet printer comprising:

a print head for delivering ink therefrom; and a waste ink absorber having a top surface, for receiving waste ink from said print head at said top surface thereof, and then absorbing said waste ink for storage therein, said waste ink absorber having:

vertically laminated layers of a plurality of ink absorbent boards each formed with a through hole vertically extending therethrough, a through-type ink absorber fitted through said through hole of each of said plurality of ink absorbent boards such that said through-type ink absorber extends through said plurality of ink absorbent boards, said through-type ink absorber being formed of a material which has a permeability sufficiently higher in a vertical direction than in a horizontal direction, and a waste ink container accommodating said waste ink absorber.

* * * * *